US010969206B1

(12) United States Patent
Burke et al.

(10) Patent No.: US 10,969,206 B1
(45) Date of Patent: Apr. 6, 2021

(54) RADIO FREQUENCY ANTENNA FOR USE IN THE CONFINES OF A BREECH

(71) Applicant: U.S. Government as Represented by the Secretary of the Army, Dover, NJ (US)

(72) Inventors: Gregory Burke, Rockaway, NJ (US); Viral Panchal, Parlin, NJ (US); James Zunino, Boonton Township, NJ (US); Stephen Bartolucci, Waterford, NY (US); Daniel Schmidt, Ambler, PA (US); Giuseppe Di Benedetto, Nutley, NJ (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/689,324

(22) Filed: Nov. 20, 2019

Related U.S. Application Data

(60) Provisional application No. 62/772,795, filed on Nov. 29, 2018.

(51) Int. Cl.
*F42B 3/113* (2006.01)
*F42B 15/10* (2006.01)

(52) U.S. Cl.
CPC ..... *F42B 3/113* (2013.01); *F42B 15/10* (2013.01)

(58) Field of Classification Search
CPC ..... F42C 11/001; F42C 13/04; F42C 13/045; F42C 13/047; F42C 19/12; F41A 19/63; F42B 3/10; F42B 5/08
USPC ... 102/200, 202, 202.5, 202.7, 202.8, 202.9, 102/202.11, 205, 206, 214
See application file for complete search history.

(56) References Cited

U.S. PATENT DOCUMENTS

| | | | | |
|---|---|---|---|---|
| 3,176,617 | A | 4/1965 | Brafford | |
| 3,601,054 | A * | 8/1971 | Christianson | F42B 5/08 102/200 |
| 4,363,273 | A | 12/1982 | Luebben | |
| 4,572,076 | A | 2/1986 | Politzer | |
| 5,036,768 | A * | 8/1991 | Dow | A61N 1/37 102/202.2 |
| 5,146,044 | A * | 9/1992 | Kurokawa | F42C 13/047 102/202.5 |
| 5,454,323 | A | 10/1995 | Conil | |
| 5,672,842 | A | 9/1997 | Brion | |
| 5,747,723 | A | 5/1998 | Buckalew | |
| 6,591,753 | B1 * | 7/2003 | Schmid | F42B 5/08 102/205 |
| 7,546,804 | B1 | 6/2009 | Tartarilla | |
| 8,607,702 | B1 * | 12/2013 | Donadio | F42C 19/12 102/202.5 |
| 10,107,607 | B1 * | 10/2018 | Burke | F42C 13/047 |
| 2006/0109327 | A1 * | 5/2006 | Diamond | D06P 5/30 347/102 |
| 2014/0083318 | A1 * | 3/2014 | Templ | F41A 17/063 102/215 |

(Continued)

*Primary Examiner* — Bret Hayes
(74) *Attorney, Agent, or Firm* — John P. DiScala

(57) ABSTRACT

A weapon system effectively, efficiently and safely transmits high energy radio frequency energy into the confines of the breech environment to initiate propelling charges. Legacy components are leveraged, along with advanced manufacturing techniques, to create antenna structures which transmit the radio frequency energy throughout the breech to initiate radio frequency-based primers.

16 Claims, 6 Drawing Sheets

(56) References Cited

U.S. PATENT DOCUMENTS

2016/0273880 A1* 9/2016 Dryer ..... F42B 15/01
2016/0305755 A1* 10/2016 Edwards ..... F41G 7/30

* cited by examiner

RADIO FREQUENCY ANTENNA FOR USE IN THE CONFINES OF A BREECH

CROSS-REFERENCE TO RELATED APPLICATIONS

This application claims the benefit under 35 USC § 119(e) of U.S. provisional patent application 62/772,795 filed on Nov. 29, 2018.

STATEMENT OF GOVERNMENT INTEREST

The inventions described herein may be manufactured, used and licensed by or for the United States Government.

BACKGROUND OF THE INVENTION

The invention relates in general to propulsion of projectiles and more particularly to propulsion of projectiles by radio frequency energy.

Conventional medium caliber and large caliber projectiles are launched by initiation of a propellant, which is either contained within a casing along with the projectile or contained in separate propelling charge cases. The propellant is typically initiated by a center-fire based primer which in turn is typically ignited through electrical or mechanical means. Medium and large caliber artillery systems and tank cannons, in particular, employ this scheme.

A feature common in many conventional artillery charges is that the ignition impetus occurs at the rear of the charge and at a single location. Under ideal conditions, single point rear ignition spreads progressively forward through the propellant bed. However, predictable progressive ignition does not always occur. Inconsistent ignition: and variation in the speed at which propelled deflagration occurs may result in a rarefaction wave phenomena which is detrimental to the weapon platform and projectile and may even cause catastrophic weapon failure. These problems become amplified as the length, weight and volume of the propellant or propelling charge increase.

A need exists for a system which allows for multipoint ignition of a propelling charge.

SUMMARY OF INVENTION

One aspect of the invention is a munition cartridge. The munition cartridge comprises a case, a fuzed projectile, a propelling charge, a radio frequency interface component, a transmitting antenna and a radio frequency ignitor. The case defines an interior volume. The fuzed projectile is partially inserted within the interior volume. The propelling charge is housed within the interior volume of the case. The radio frequency interface component couples received radio frequency energy from the exterior of the case to the interior volume of the case. The transmitting antenna is located within the interior volume of the case. The transmitting antenna is in communication with the radio frequency interface and transmits the received radio frequency energy throughout the interior volume. The radio frequency ignitor utilizes the transmitted radio frequency energy to ignite the propelling charge.

The propelling charge case comprises a case, a propelling charge, a radio frequency interface component, a transmitting antenna and a radio frequency ignitor. The case defines an interior volume. The propelling charge is housed within the interior volume of the case. The radio frequency interface component couples received radio frequency energy from the exterior of the case to the interior volume of the case. The transmitting antenna is located within the interior volume of the case. The transmitting antenna is in communication with the radio frequency interface and transmits the received radio frequency energy throughout the interior volume. The radio frequency ignitor utilizes the transmitted radio frequency energy to ignite the propelling charge.

The invention will be better understood, and further objects, features and advantages of the invention will become more apparent from the following description, taken in conjunction with the accompanying drawings.

BRIEF DESCRIPTION OF THE DRAWINGS in the drawings, which are not necessarily to scale, like or corresponding parts are denoted by like or corresponding reference numerals.

DETAILED DESCRIPTION

Figure 1:
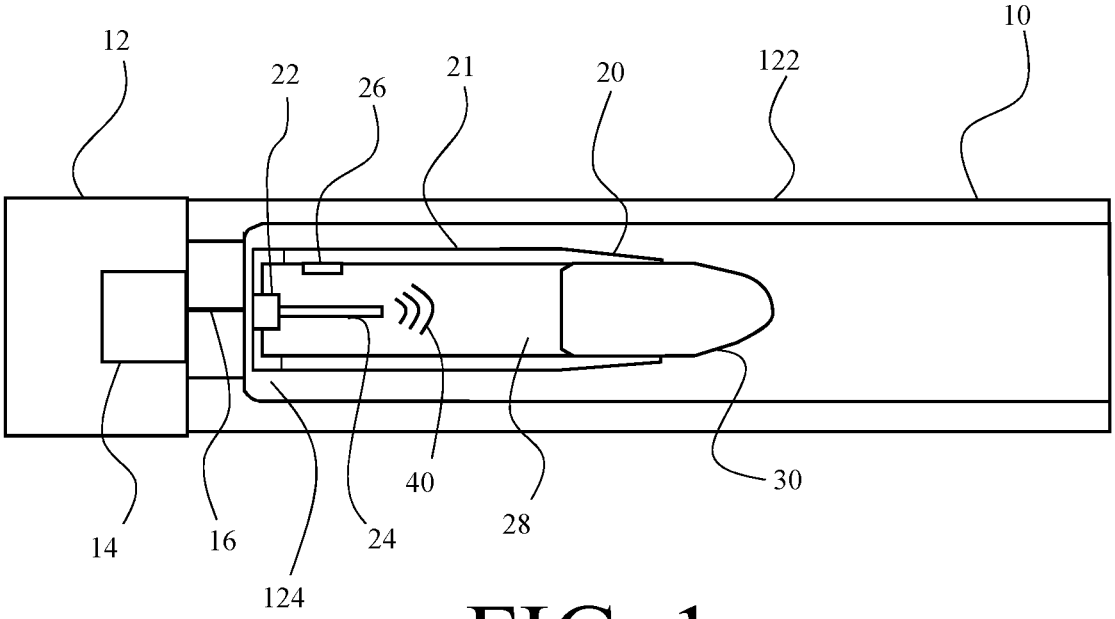
FIG. 1 is a cross-section view of a weapon system configured for initiating a propellant chain with radio frequency energy and a corresponding munition, according to one illustrative embodiment.

A projectile is launched by a propelling charge which is initiated through radio frequency (RF) energy, RE energy is introduced into the confines of a cannon breech. A transmitting antenna radiates the RE energy such that it can be received by a RE-based ignition source thereby initiating the propellant chain.

The ignition modality is particularly suited for use in medium and large caliber munitions and weapon systems and is intended as a replacement for the traditional mechanical and/or electrical based chemical primer. Throughout this specification, the invention will be described in the context of an artillery munition and associated propelling Charges. However, the projectile is not limited to artillery projectiles. The novel features may also be applied to tank ammunition or other large, medium or small caliber munitions. Further, the invention is not limited solely to initiating propelling charges for munitions. Those skilled in the art will appreciate that the systems and methods described herein may be applied to launch non-munition projectiles such as commercial or research projectiles.

The system described provides increased performance over traditional mechanical and electrical based chemical primers and flexibility to tailor the ignition sequence to the particular application or desired performance, Ignition can occur at a single point or at multiple points located throughout the charge body. The ignition can be simultaneous or sequentially, programmable. The ignition process can be started within the center of the charge, or exterior, depending on the charge geometry and the placement of RE-based ignition sources. Advantageously, this invention enables the use of larger propelling charges to provide long range capability to powder based artillery.

The form and location of the transmitting antenna and related RF-based ignition source are dependent on the application and type of propelling charge employed. In one embodiment, the transmitting antenna is contained within the cannon breech and the related RF-based ignition sources are disposed on a formed case of artillery propelling charge similar in form to the M231/M232A1 Modular Ammunition Charge System (MACS) used in currently-fielded 155 mm howitzer systems. In another embodiment, the transmitting structure RF-based ignition sources are contained within the body of an extended case charge similar to that of legacy charges used for tank based munitions. Alternatively, in another embodiment, the transmitting structure and RF-based ignition sources are contained within the body of a propelling charge.

The transmitting structure includes a radiating conductive element which can be a traditional wire or rod based antenna or, alternatively, may be a printed conductive ink structure placed or printed on an inside surface of the charge ease. For example, the transmitting structure can be printed using conductive paint, ink, or filament printing techniques on a consumable case material, such as foamed celluloid, in applications where the charge case is metal, the conductive transmitting structure may be printed or placed over a dielectric coating or conformal layer.

Advanced techniques in the printing of conductive inks allows for the ability to design and print low cost, one time use transmitting structures. The radiating transmitting structures can be printed in a wide variety of shapes and forms which are tailored to the input RF source wavelength. This approach is diametrically opposed to current and past efforts of using a single, electrical or mechanical based method to ignite a propellant bed and/or charge cartridge. The choice of transmitting structure, frequency tuning, design and specific features are determined by the wavelength, physical dimensions of the breech and the optimization for uniform dispersion of the RF energy within the breech confines.

The RF transmitting antenna is sufficiently robust to withstand a high RF energy pulse of a duration necessary to ensure ignition of the micro-electronic RF-based ignition sources. However, the RF transmitting antenna is also manufactured from materials that if consumed during the burning of the propellant pose no risk to the weapon itself or personnel.

The transmitting antenna is used in conjunction with the RF-based ignition sources to initiate the propellant chain. The RF-based ignition source receives the electromagnetic energy transmitted by the transmitting antenna and coverts it to a stimulus for initiating the propellant chain. As will be described further below, the RF-based ignition source may convert the RF energy into thermal energy or alternatively may power an initiation device, such as a laser. In one embodiment, the RF-based ignition sources are RF inductively coupled primers previously disclosed in U.S. Pat. No. 10,107,607, the entire contents of which are hereby incorporated by reference.

Multiple RE-based ignition sources can be strategically located within the charge body. Application of RF energy to the transmitting antenna allow for simultaneous coupling and ignition of multiple RE-based ignition sources.

To couple an external RF energy source to the transmitting antenna, the munition may leverage a radio frequency interface connection (RFIC). The MC is a cylinder with an electrically isolated center pin. The RFIC is employed as an RF coupling mechanism and may or may not contain energetic materials. Advantageously, the RFIC may be retrofitted from currently available ammunition. For example, the stub base of a typical tank cartridge comprises a primer based electrical interface which may be employed as a RFIC. In legacy systems electrical ignition energy is coupled into the primer body and thusly into the munition at this location. However, instead of localized ignition of a pyrotechnic material, as typical of the present system, the RFIC couples RF energy into a transmitting antenna within the charge case. The transmitting structure radiates RF energy throughout the body of the charge. Ignition occurs when this energy impinges on RF sensitive primer device(s) located a within the charge body.

To ensure safety from extraneous RF energy sources and to minimize risk from accidental ignition from a directed energy weapon (DEW), the RF energy necessary for initiation of the RF-based ignition source is relatively high. In addition, programmable electronic elements can be added to the RE-based ignition sources to increase security. The programmable elements can be configured to ensure that the proper signal has been provided prior to activating the RE-based ignition source. For example, in one embodiment, a biometric key may be required to unlock the RF-based ignition source.

The high power RE source delivers the high power RE energy. In one embodiment of the invention, the RE energy is at a frequency in the microwave band of the electromagnetic spectrum. The RF source may be located on the weapon platform, the output of which is confined within a coaxial RF conducting cable directed to the breech of the weapon. The use of a coaxial cable ensures that the high level of RF energy is confined to ensure the safety of personnel. The use of a coaxial cable also ensures that extraneous external RE radiation sources, such as a DEW, are unable to activate the RF ignition system. The systems described throughout effectively, efficiently and safely transmit high energy RE energy into the confines of the breech environment without compromising the integrity of the pressure vessel, FIG. 1 is a cross-section view of a weapon system configured for initiating a propellant chain with radio frequency energy and a corresponding munition, according to one illustrative embodiment. The weapon system 10 comprises a weapon platform 12 including a cannon body 122, an RF emitter 14 and RF transmission cable 16. The corresponding munition 20 further comprises a cartridge case 21, an UK; 22, a transmitting antenna 24, an RF-based ignition source 26, alternatively referred to as an RF ignitor 26, a propelling charge 28 and a projectile 30. In the embodiment shown, the weapon system 10 is a cannon-based weapon system, such as an artillery weapon system.

The RF emitter 14 produces a burst of electromagnetic energy 40 for a short duration coupled into and through an RF transmission cable 16. For example, the RF emitter 14 may be a high power emission source, such as a magnetron, that may broadcast energy into the breech at a sufficient level to ensure ignition. In one embodiment, the RF emitter 14 radiates approximately 1 kilowatt (kW) of energy for a duration of approximately 1 millisecond (ms). In the embodiment shown, the RF emitter 14 may be mounted on or located within the weapon platform 12.

The output of the RF emitter 14 is confined within an RE transmission cable 16 directed to the breech 124 of the cannon body 122. The RE transmission cable 16 couples the RF emitter 14 to the breech 124 of the cannon body 122, In one embodiment, the RF transmission cable 16 is a coaxial RE conducting cable.

The munition 20 is loaded into the weapon system such that it sits in the breech 124 of the cannon body 122. The cartridge case 21 houses the internal components of the munition 20 and provides protection from the exterior environment while also presenting an aerodynamic surface for ballistic flight.

The RFIC 22 is in electrical communication with an output end of the RF transmission cable 16 and couples the RF transmission cable 16 to the transmitting antenna 24. As will be described in further detail below, the RFIC 22 is located in either a propelling charge case or the cartridge case of the munition. In the embodiment shown, the RFIC 22 is located in the cartridge case 21 such that one end of the RFIC 22 is accessible from the exterior of the cartridge case 21 and another end is accessible to the transmitting antenna 24.

The transmitting antenna 24 receives the RF energy via the RFIC 22 and transmits the energy 40 throughout the breech 124 of the cannon 122. The breech 124 being made of thick steel and completely sealed ensures that no RF energy escapes or places any personnel at risk from exposure.

The transmitting antenna 24 may be an exposed limited use antenna or can be covered within a rugged, long life ceramic composite structure. However, the transmitting antenna 24 is not limited to ceramics but may instead use a combination of various conductive and/or dielectric composites, meta-materials or metals to achieve the same result. The breech 124 of the cannon body serves as a cavity resonator, radiating the RF energy 40 within the breech 124.

The RF ignitor 26 receives the electromagnetic energy 40 and converts it to initiate an energetic chain, such as a propellant chain. The conversion process can be a thermal conversion or a more complex method such as the driving of a laser initiation device or ignition source. In one embodiment, the RF ignitor 26 receives the electromagnetic energy via an RF absorption material, such as a receiving antenna, and initiates a primer charge of an ignition chain, through dielectric heating, which progresses into the main propelling charge 28. Such an RF ignitor is described in co-owned U.S. Pat. No. 10,107,607.

In another embodiment, the RF ignitor 26 receives the electromagnetic energy 40 to produce an electric voltage for powering an ignition device such as a laser initiation device. In this embodiment, ignition is initiated through a microelectronic package which may be capable of providing bi-directional communication as well as ignition. For example, the temperature, age, lot and other attributes of the propellant may be communicated over the bi-directional communication link.

One or more radio frequency igniters may be employed to achieve multipoint ignition of the propelling charge or charges 28. Depending on the number and type of the propelling charge or charges 28, multiple RF ignitors 26 may be coupled to a single charge 28, multiple charges 28 may each have a coupled RF ignitor 26 or there may be a combination of the two. In applications in which multiple discrete propelling charges 28 are employed in the artillery system, such as in a modular or staged system like the MACS, an RF ignitor ay be attached to each propelling charge 28.

Upon reception of the radiated RF energy 40, each RF ignitor 26 simultaneously ignites their respective propelling charge 28 thereby providing reliable multipoint Reliable multipoint ignition ensures ballistic predictability for the propelling round. By simultaneously igniting the multiple charges 28, the premature detonation of subsequent charges 28 in the propulsion chain is negated as may be experienced in traditional rear ignition systems.

In applications employing one or more relatively longer propelling charge bundles 28 in a single case, it may be advantageous to attach multiple RF ignitors 26 to a single charge 28 to achieve multipoint ignition within the charge 28. For example, depending on the type and location of the propellant within the charge 28, multiple RF ignitors 26 can ensure simultaneous ignition of all propellant within the charge 28 thereby providing the benefits described above.

Figure 2:
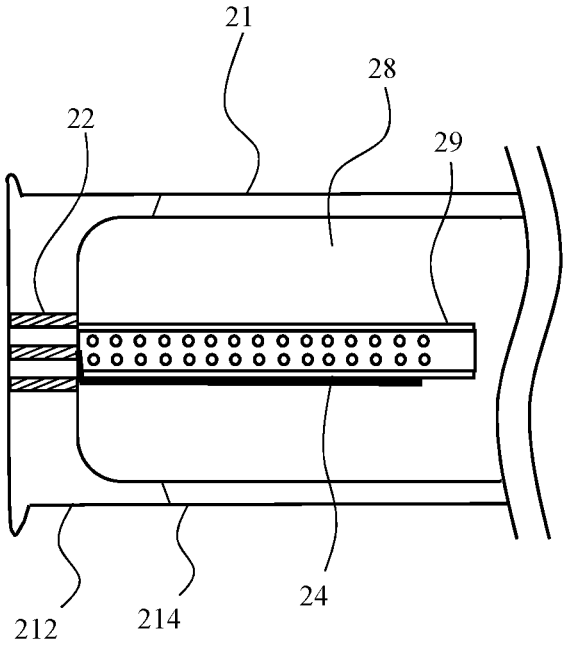
FIG. 2 is a side cross-section view of a munition, according to one illustrative embodiment.

FIG. 2 is a side cross-section view of a munition, according to one illustrative embodiment. The munition is a cased charge munition wherein the propelling charge 28 is housed within the case 21 along with the warhead, as is common in tank ammunition and certain artillery ammunition. In such embodiments, legacy components may be leveraged to initiate the propelling charge 28 with RF energy 40. In particular, the legacy picollo tube 29 may serve as a support structure for the transmitting antenna 24 and the legacy coaxial electrical connection may serve as the RFIC 22.

The munition case 21 comprises a base cap 212 and a case body 214. The base cap 212 is a closed end hollow cylinder with the case body 214 partially inserted into the open end of the cylinder. The base cap 212 is formed from a metal material, such as brass. The case body 214 is typically formed from a consumable material, such as foamed celluloid.

Together, the base cap 212 and case body 214 form a hollow closed end cylinder for housing the propelling charge 28 of the munition. A piccolo tube 29 extends from the base cap 212 into the propelling charge 28 of the munition. The piccolo tube 29 further comprises a transmitting antenna 24 disposed on a surface of the picollo tube 29. A fuzed projectile 30 is disposed within an opening in the top of the case body 212 and is partially seated within the internal cavity of the case 22.

Figure 3:
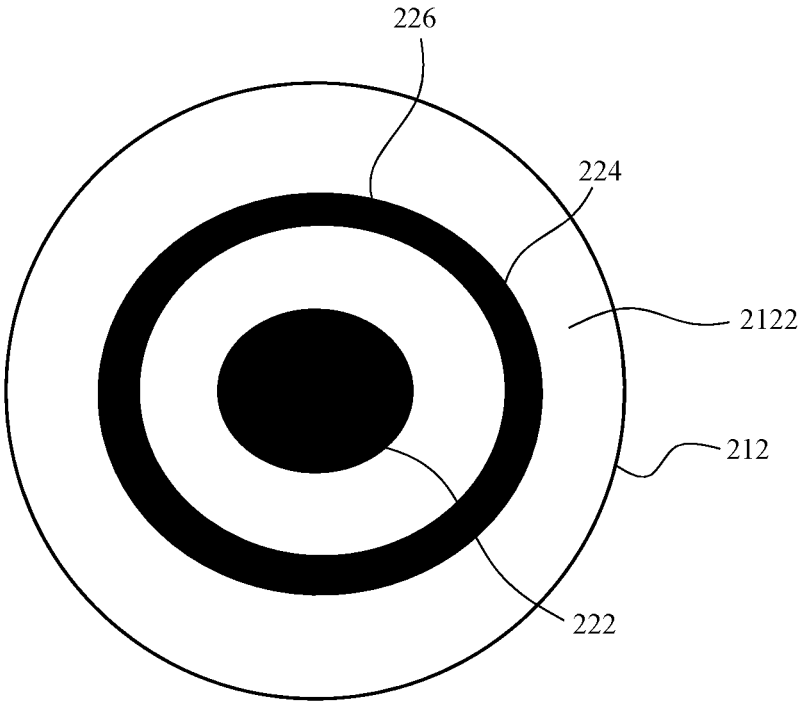
FIG. 3 is a back view of a munition having an electrical connection, according to one illustrative embodiment.

FIG. 3 is a back view of the base cap of a munition, in accordance with an illustrative embodiment of the invention. The base cap 212 defines a cylindrical hole at the center of the base cap 212, The RFIC 22 is disposed within the hole and extends from an exterior surface 2122 of the base cap 212 to an interior volume of the munition. The RFIC 22 is positioned in the base 2122 of the case 21 such that when the case 21 is loaded into the breech 124 of the cannon 122, the RFIC 22 is in contact with the output end of the RE transmission cable 16.

The RFIC 22 is a coaxial connection, similar in form to the coaxial connections currently employed on conventional tank ammunition. The RFIC 22 comprises an isolated center contact 222 and a concentric conductive ring 224. The center contact 222 is surrounded by a layer of dielectric material 226 thereby isolating the center contact 222. The exterior surface 2122 of the base cap 212 serves as a ground plane extending 360 degrees around the center contact 222.

Figure 4:
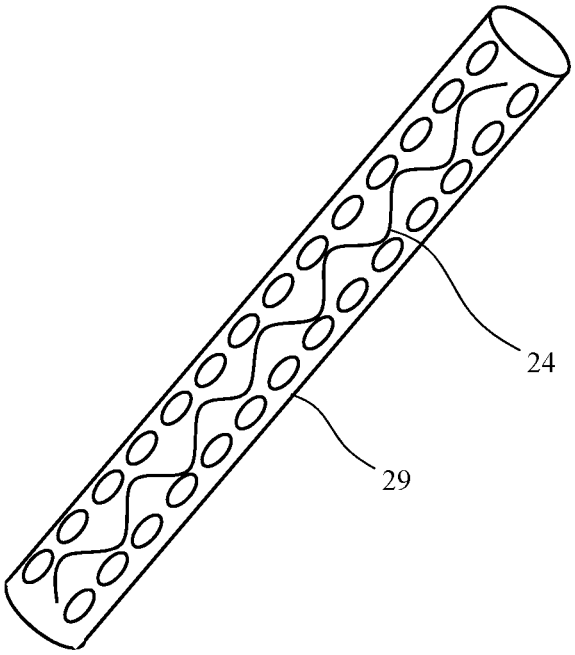
FIG. 4 is a perspective view of a piccolo tube, according to one illustrative embodiment.

FIG. 4 is a perspective view of a piccolo tube, in accordance with one illustrative embodiment. The munition in FIG. 2 further comprises a piccolo tube 29, also known as an ignitor tube. The piccolo tube 29 extends from the RFIC 22 into the internal cavity of the munition 20 and is in electrical communication with the RFIC 22.

The transmitting antenna 24 can be placed on the interior or exterior of the existing piccolo tube 29 structure. The piccolo tube 29 structure can be metal, as in legacy components, or made from consumable materials, such as foamed celluloid. Alternatively, the piccolo tube 29 may be manufactured from a variety of composite materials depending on desired material properties. The transmitting antenna 24 can take the form of a wire or rod disposed on the piccolo tube 29 through traditional manufacturing techniques or by additive manufacturing techniques. Alternatively, the transmitting antenna 24 may be printed onto the piccolo tube 29 from a conductive ink using printed conductive ink methodologies.

The antenna pattern is designed to uniformly distribute the RF energy within the confines of the breech structure, Dependent on placement of the RE ignitors 26 within the case, ignition can occur at, within, upon, adjacent too, or at multiple locations within the charge body.

Figure 5:
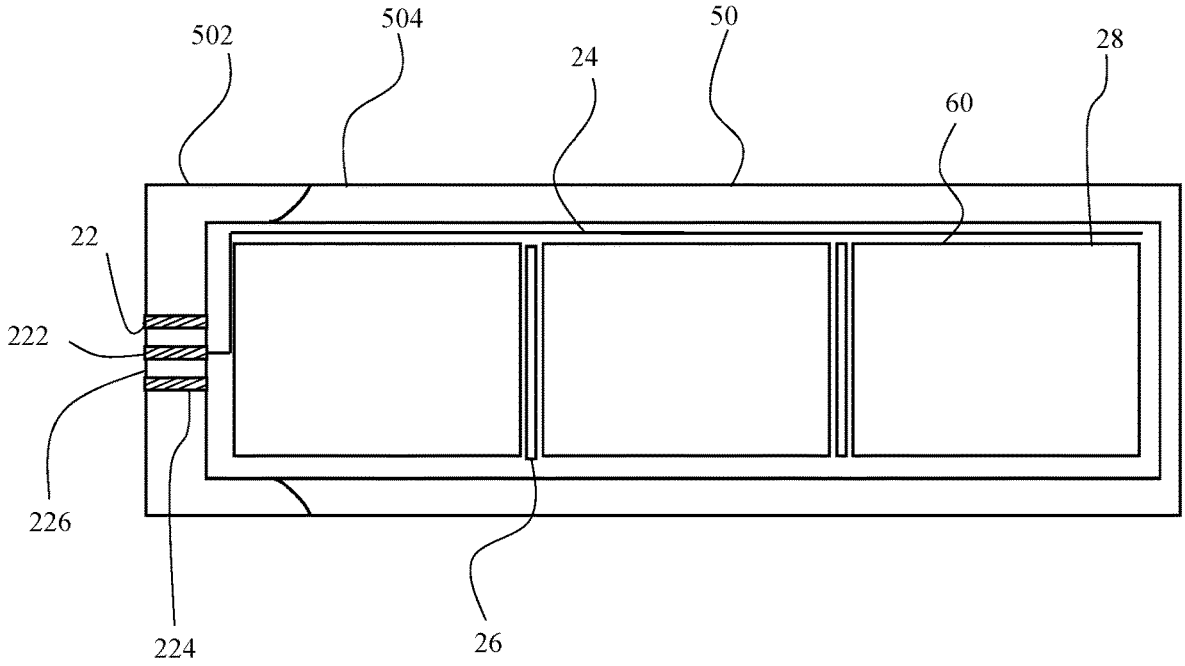
FIG. 5 is a side cross-section view of a propelling charge, according to one illustrative embodiment.

FIG. 5 is a side cross-section view of a propelling charge, in accordance with one illustrative embodiment. In embodiments in which the projectile is propelled from one or more propelling charges 28 such as in a modular or staged system like MACS or a system employing one or more relatively longer charges 28 comprising multiple charge bundles within, the transmitting antenna 24 may be printed on an interior surface or exterior surface of a propelling charge 28. FIG. 5 shows a propelling charge 28 in which multiple bundles 60 of propellant are housed in a relatively long case 50.

The propelling charge case 50 comprises a base cap 502 and a case body 504. The base cap 502 is a closed end hollow cylinder with the case body 504 partially inserted into the open of the cylinder. Both the base cap 502 and the case body 504 may be formed from a consumable material, such as foamed celluloid.

Together, the base cap 502 and case body 504 form a hollow cylinder closed at both ends. Multiple propellant bundles 60 are housed within the interior volume of the case 50. RF ignitors 26 are disposed on or between each of the bundles 60. When the primer of the RF ignitor 26 is energized with RF energy 40, ignition can occur at, within, upon, adjacent too, or at multiple locations within the charge 28.

The base cap 502 defines a cylindrical hole at the center of the base cap 502. The RFIC 22 is disposed within the hole and extends from an exterior surface of the base cap 502 to an interior volume of the propelling charge 28. The RFIC 22 is positioned in the base 502 of the case 50 such that when the case 50 is loaded into the breech 124 of the cannon, the RFIC 22 is in contact with the output end of the RF transmission cable 16.

Figure 6:
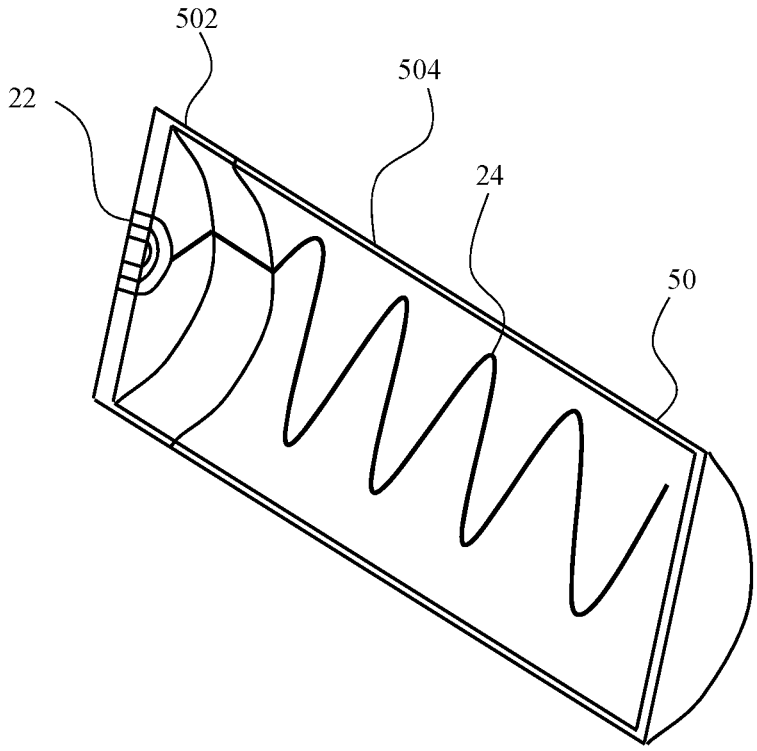
FIG. 6 is a perspective view of a propelling charge case with a cutaway showing the interior cavity of the case, according to one illustrative embodiment.

The RFIC 22 is a coaxial connection, similar in form to the coaxial connections currently employed on conventional tank ammunition. The RFIC 22 comprises an isolated center contact 222 and a concentric conductive ring 224. The center contact 222 is surrounded by a layer of dielectric material 226 thereby isolating the center contact 222, FIG. 6 is a perspective view of a propelling charge case with a cutaway showing the interior cavity of the case, in accordance with one illustrative embodiment. The transmitting antenna 24 is disposed on the interior surface of the case 50. The transmitting antenna 24 can take the form of a wire or rod manufactured and assembled through traditional manufacturing techniques or by additive manufacturing techniques. Alternatively, the transmitting antenna 24 may be a conductive ink using printed conductive ink printed onto the surface of the case 50 using printed conductive ink methodologies.

The antenna pattern is designed to uniformly distribute the RF energy 40 within the confines of the breech structure. Dependent on placement of the RF ignitors 26 within the ease 50, ignition can occur at, within, upon, adjacent too, or at multiple locations within the charge 28.

The case 50 comprises a base 502 and a body 504 and is formed from a consumable material, such as foamed celluloid. The RFIC 22 extends through the base 502 of the case 50 from an exterior surface of the base 502 to the interior volume of the case 50, As described above, the RFIC 22 is a coaxial connector comprising an inner conductor 222 and an outer conductor 224 separated by a dielectric insulator 226.

While the invention has been described with reference to certain embodiments, numerous changes, alterations and modifications to the described embodiments are possible without departing from the spirit and scope of the invention as defined in the appended claims, and equivalents thereof.

What is claimed is:

1. A munition cartridge comprising:

a case defining an interior volume;

a fuzed projectile seated within the case;

a propelling charge housed within the interior volume of the case;

a radio frequency interface component for coupling received radio frequency energy from an exterior of the case to the interior volume of the case;

a transmitting antenna located within the interior volume of the case, the transmitting antenna in communication with the radio frequency interface and transmitting the received radio frequency energy throughout the interior volume;

a piccolo tube extending from an interior base of the case into the interior volume and wherein the transmitting antenna is disposed on a surface of the piccolo tube; and a radio frequency ignitor for utilizing the transmitted radio frequency energy to ignite the propelling charge.

2. The munition cartridge of claim 1 wherein the case comprises a base cap and a case body.

3. The munition cartridge of claim 2 wherein the base cap is a stub case.

4. The munition cartridge of claim 1 wherein the radio frequency interface component is a coaxial interface component.

5. The munition cartridge of claim 4 wherein the radio frequency interface component is located within an opening defined by a base of the case and extends from an exterior surface of the base to an interior base of the case.

6. The munition cartridge of claim 1 wherein the transmitting antenna is formed from a conductive ink printed on a surface of the piccolo tube.

7. The munition cartridge of claim 1 wherein the radio frequency ignitor further comprises a first layer, a second layer and an initiating charge disposed between the first layer and the second layer wherein the first layer further comprises a receiving antenna for receiving the burst of radio frequency energy and converting to thermal energy for igniting the initiating charge.

8. The munition cartridge of claim 1 wherein the radio frequency ignitor further comprises a micro-electronics laser powered by the radio frequency energy.

9. A propelling charge case comprising:

an interior volume;

one or more propelling charges housed within the interior volume;

a radio frequency interface component for coupling received radio frequency energy from an exterior of the propelling charge case to the interior volume of the propelling charge case;

a transmitting antenna disposed on an interior surface of the propelling charge case, the transmitting antenna in communication with the radio frequency interface and transmitting the received radio frequency energy throughout the interior volume; and a radio frequency ignitor for utilizing the transmitted radio frequency energy to ignite the one or more propelling charges.

10. The propelling charge case of claim 9 wherein the propelling charge case is formed from a consumable material.

11. The propelling charge case of claim 9 wherein the radio frequency interface component is a coaxial interface component.

12. The propelling charge case of claim 11 wherein the radio frequency interface component is located within an opening defined by a base of the propelling charge case and extends from an exterior surface of the base to an interior surface of the base.

13. The propelling charge case of claim 9 wherein the transmitting antenna is formed from a conductive ink.

14. The propelling charge case of claim 9 wherein the radio frequency ignitor further comprises a first layer, a second layer and an initiating charge disposed between the first layer and the second layer wherein the first layer further comprises a receiving antenna for receiving the burst of radio frequency energy and converting to thermal energy for igniting the initiating charge.

15. The propelling charge case of claim 14 wherein the one or more propelling charges comprises a plurality of propellant stick bundles and wherein each of the propellant stick bundles has an associated radio frequency ignitor attached.

16. The propelling charge case of claim 9 wherein the radio frequency ignitor further comprises a micro-electronics laser powered by the radio frequency energy.

* * * * *